United States Patent [19]

Doty

[11] 4,043,286

[45] Aug. 23, 1977

[54] BOAT HULL SCRUBBING APPARATUS

[76] Inventor: Frederick L. Doty, Rte. 47 West, P.O. Box 152, Monticello, Ill. 61856

[21] Appl. No.: 687,193

[22] Filed: May 17, 1976

[51] Int. Cl.[2] ..... B63B 59/00

[52] U.S. Cl. ..... 114/222; 15/DIG. 2

[58] Field of Search ..... 114/222; 15/DIG. 2

[56] References Cited

U.S. PATENT DOCUMENTS

| | | | |
|---|---|---|---|
| 2,803,025 | 8/1957 | Morrison | 15/DIG. 2 |
| 3,227,124 | 1/1966 | Campbell | 114/222 |
| 3,456,275 | 7/1969 | Solomon | 15/DIG. 2 |
| 3,541,988 | 11/1970 | Laney | 114/222 |
| 3,561,391 | 2/1971 | Locati | 114/222 |
| 3,662,417 | 5/1972 | Führing et al. | 15/DIG. 2 |
| 3,752,109 | 8/1973 | Seiple | 114/222 |
| 3,800,732 | 4/1974 | Hill | 114/222 |

FOREIGN PATENT DOCUMENTS

| | | | |
|---|---|---|---|
| 116,275 | 7/1969 | Norway | 114/222 |

*Primary Examiner*—Trygve M. Blix
*Assistant Examiner*—Stuart M. Goldstein
*Attorney, Agent, or Firm*—Koenig, Senniger, Powers and Leavitt

[57] ABSTRACT

Apparatus for scrubbing the hull of a boat comprising a pair of side frames spaced for a boat to be floated therebetween and a pair of generally horizontal power driven brushes extending transversely between the side frames. The brushes are pivotally secured together at their inner ends and are so mounted on the side frames that the position of the brushes is changeable as a boat floats over the brushes so that the brushes are maintained in scrubbing engagement with the bottom of the boat hull.

13 Claims, 8 Drawing Figures

BOAT HULL SCRUBBING APPARATUS

BACKGROUND OF THE INVENTION

This invention relates to apparatus for scrubbing the hull of a boat, and more particularly to such apparatus which scrubs the hull of a boat clean of marine growth, scum, oil and the like, without removing the boat from the water.

Boats which are continuously in the water are subject to accumulations of dirt, aquatic plant growth, and certain marine animals (e.g., barnacles if the boat is in salt or brackish water). This dirt and marine growth, if not removed, may cause the drag of the boat hull to increase sharply thus reducing the speed of the boat and increasing its fuel consumption. Also, oil films and other deposits may build up on the hull above and below the water line thus spoiling the appearance of the boat. Boat owners thus often find it necessary to periodically clean their boat's hull.

For smaller boats which may be readily trailered, such as outboard runabouts and smaller cruisers, the boat hull may be cleaned by trailering the boat and manually scrubbing the hull. While the expense of cleaning these smaller boats may not be substantial, it does take considerable time and effort. In order to clean larger boats, such as cabin cruisers, houseboats, or commercial boats, the boat must be hoisted out of the water (i.e., dry docked) and then manually scrubbed clean. Thus, not only do these larger boats require considerably more time and work to clean, but the expense of dry docking the boat for cleaning may be substantial. Oftentimes the owner of a large boat must pay a commercial boat repair yard to clean the hull. In certain geographic areas, hulls must be sometimes cleaned several times each boating season and thus the yearly cost of cleaning a larger boat is substantial.

Heretofore, several boat hull cleaning apparatus have been suggested. These prior art hull cleaning apparatus have, for the most part, either involved the use of brushes mounted on the boat and movable over its hull, or the use of brushes carried by a dock or other structure for scrubbing the boat hull as the boat and the brushes are moved relative to one another. In this last type of boat prior art cleaning apparatus, the brushes were mounted for vertical movement so as to accommodate boat hulls of different drafts, but could not readily conform to various hull shapes (e.g., V-shaped, rounded, or flat hulls).

Reference is made to U.S. Pat. Nos. 3,227,124, 3,561,391 and 3,541,998 and to Norwegian Pat. No. 116,275 which illustrate prior art boat hull scrubbing apparatus.

SUMMARY OF THE INVENTION

Among the several objects of this invention may be noted the provision of boat hull scrubbing apparatus, such as above-described, which rapidly and thoroughly cleans dirt and aquatic growth from a boat hull without removing the boat from the water; the provision of such apparatus which automatically conforms to any hull shape or depth; the provision of such apparatus which uses no special chemicals or detergents to clean the boat hull and thus does not pollute the water; the provision of such apparatus which scrubs the sides as well as the bottom of the boat hull; the provision of such apparatus in which the scrubbing force applied to the sides of the boat hull is maintained below a desired value so as to prevent the application of excessive force to the boat hull sides; the provision of such apparatus which need not be as long as the boat to be scrubbed; the provision of such apparatus which is of rugged construction, which rapidly scrubs clean a boat hull, which is reliable in operation, and which is economical to purchase and operate.

Apparatus of this invention for scrubbing the hull of a boat comprises a frame having two portions spaced from one another a distance sufficient for a boat to be floated therebetween. A pair of power-driven brushes extend transversely between the frame portions and means is provided mounting each of these brushes for rotation about its longitudinal axis. These mounting means are pivotally secured together adjacent their inner ends and each is secured to its respective frame portion for vertical and angular movement of the brushes relative to their respective frame portion and for pivotal movement of the brushes relative to one another from a first position in which the brushes are generally horizontal for engagement by the hull of the boat to be cleaned to a second position in which the brushes are disposed below the hull of the boat. The position of the brushes is changeable to conform to the shape and depth of the boat hull whereby the brushes are maintained in scrubbing engagement with the boat hull as the latter is floated over the brushes.

Other objects and features of this invention will be in part apparent and in part pointed out hereinafter.

A BRIEF DESCRIPTION OF THE DRAWINGS

Corresponding reference characters represent corresponding parts throughout the several views of the drawings.

DESCRIPTION OF A PREFERRED EMBODIMENT

Figure 1:
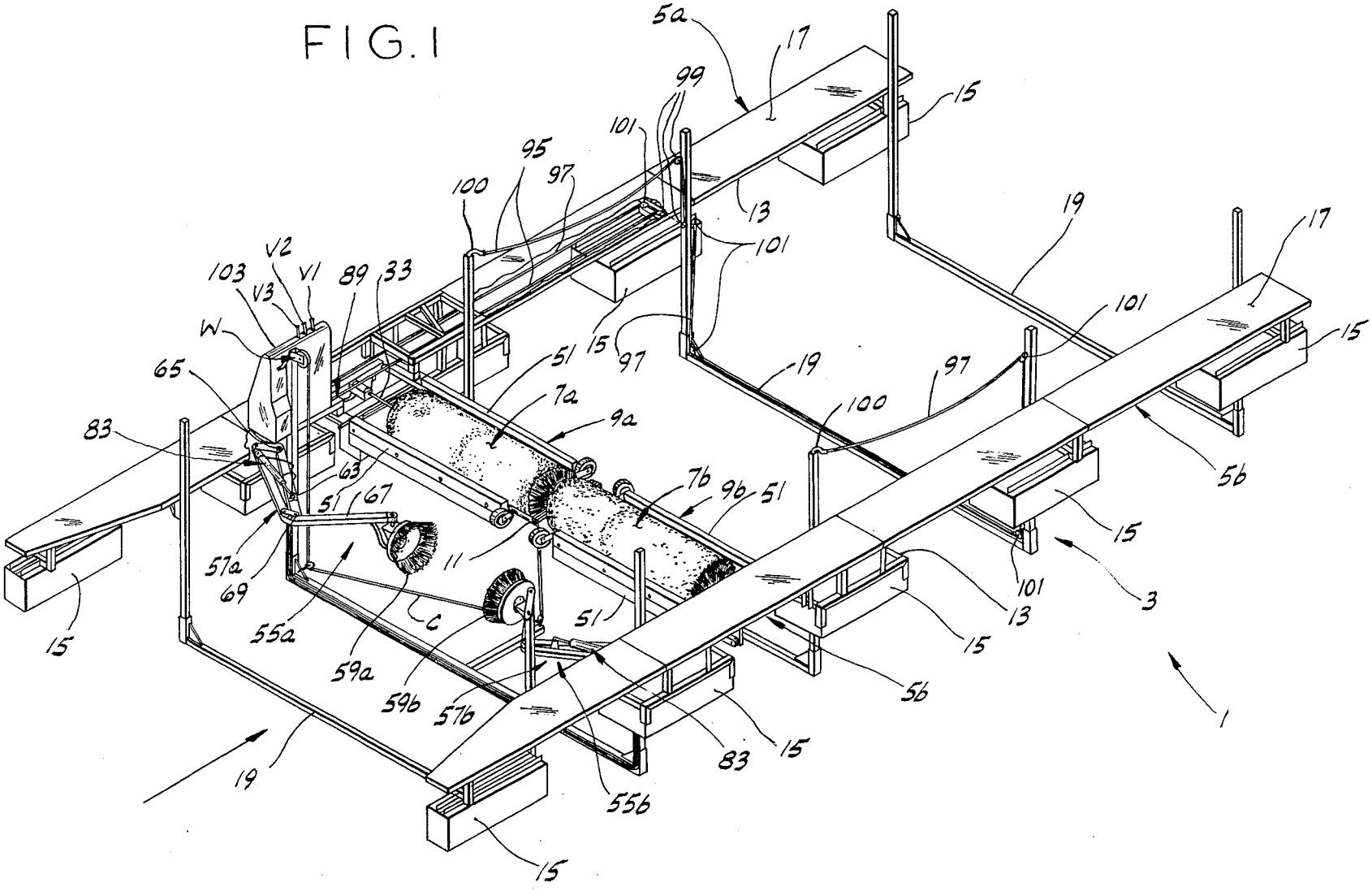
FIG. 1 is a perspective view of boat hull scrubbing apparatus of this invention.
Figure 2:
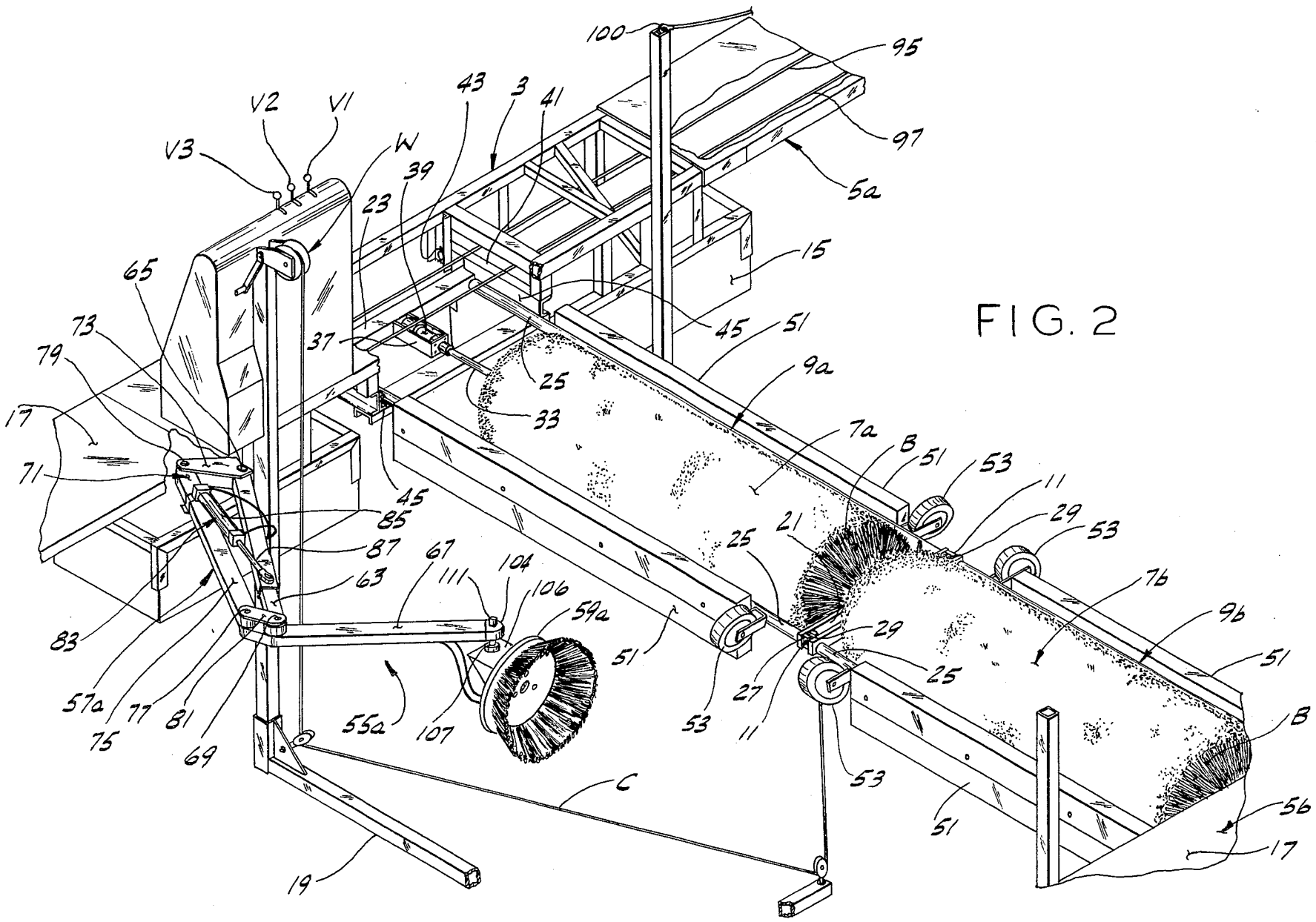
FIG. 2 is an enlarged perspective view of a portion of the apparatus.
Figure 3:
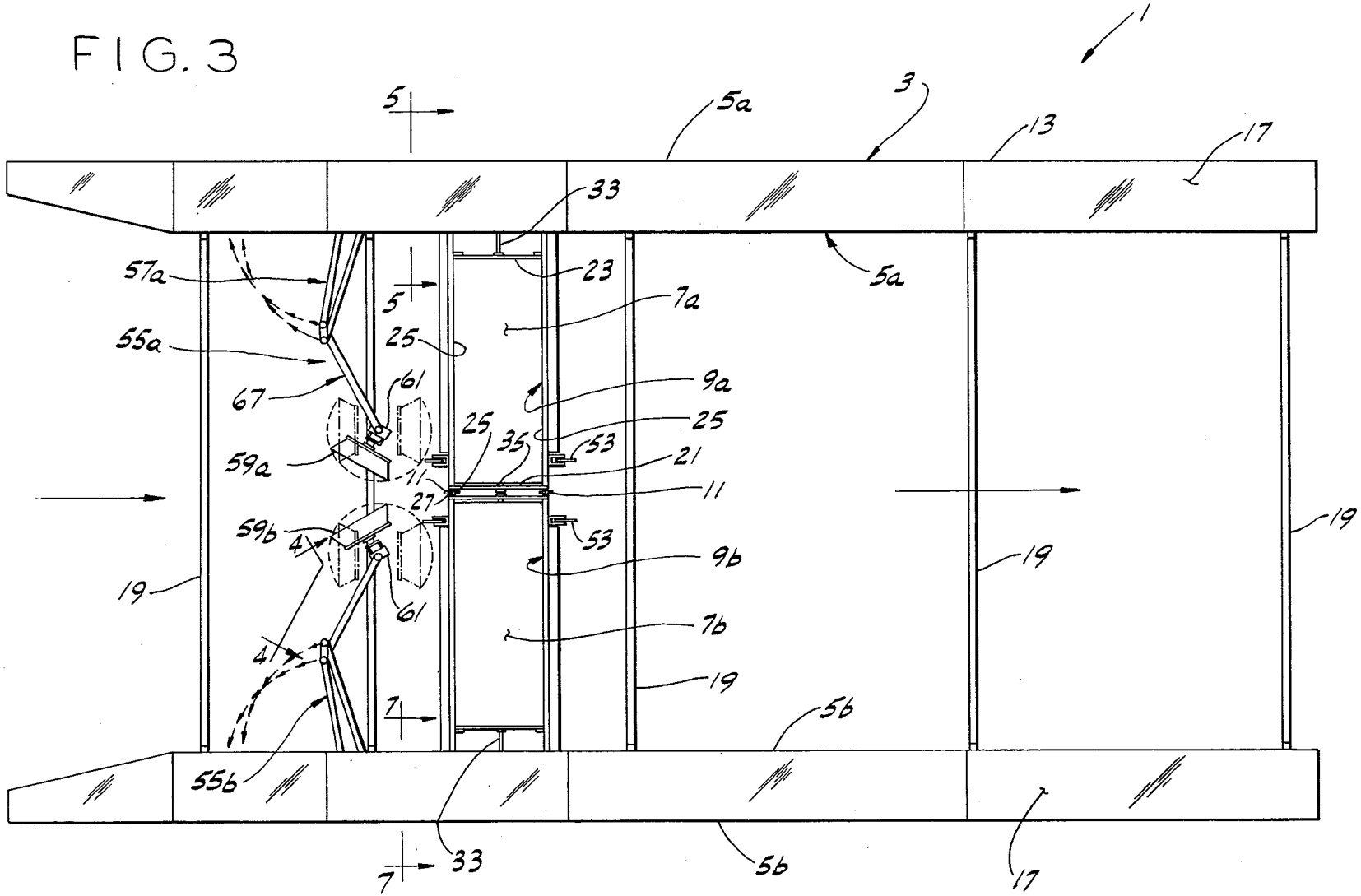
FIG. 3 is a plan view of the apparatus illustrating movement (as indicated by the arrows) of a pair of side brushes from an extended scrubbing position (shown) to a retracted position and further illustrating various scrubbing positions for the side brushes for scrubbing the front, sides and rear sidewalls of a boat hull as the latter is floated between the side brushes.

Referring now to the drawings, boat hull scrubbing apparatus of this invention, indicated in its entirety at 1, is shown to have a frame 3 including two side frames 5*a*, 5*b* spaced from one another a distance sufficient to float a boat to be cleaned therebetween with one end of the frame (i.e., the left end of the frame as viewed in FIGS. 1–3) constituting the entrance end of the apparatus and with the other end of the frame constituting the exit end of the apparatus. The apparatus further includes a pair of power-driven bottom hull scrubbing brushes 7*a*, 7*b* extending generally transversely between the side frames. Each of these brushes is mounted in a respective support frame 9*a*, 9*b* for rotation about its longitudinal axis. As is best shown in FIGS. 2 and 3, the support frames are pivotally secured together (i.e., hinged or pinned) by pins 11 adjacent the inner ends of brushes 7*a*, 7*b*. The support frames are also secured to their respective side frames 5*a*, 5*b* for both vertical and angular movement of the support frames and the brushes carried thereby relative to the frame portions. Thus, the brushes and the support frames may move both vertically and angularly relative to the side frames and pivotally relative to one another from a first position (shown in FIG. 1) in which the brushes are generally horizontal for engagement by the hull of a boat to be cleaned to a second position (not shown) in which the bottom brushes are disposed below the water line and below the hull. The position of the brushes is changeable in response to movement of the hull therepast so as to enable the brushes to conform to the shape and depth of the hull whereby the brushes are maintained in proper scrubbing engagement with the bottom of the boat hull as it passes thereover.

More particularly, each of the side frames 5*a*, 5*b* consists of a series of frame sections 13 secured together in end-to-end relation. Each of the frame sections has one or more flotation blocks 15 of rigid plastic foam flotation material (e.g., rigid urethane foam or the like) secured thereto and an upper deck 17 constituting a catwalk. With the frame in the water, the flotation blocks have sufficient buoyancy to support decks 17 above the level of the water and enable bottom brushes 7*a*, 7*b* to be disposed generally horizontally when in their above-stated first position with at least the upper portions of the brushes extending out of the water for scrubbing engagement with the hull as the latter is moved onto the bottom brushes. The side frames are held in spaced relation relative to one another by a plurality of U-shaped spanning members 19 extending down below the water level and transversely between the frame portions. These spanning members are below the water level a distance sufficient to permit all boats of the maximum size contemplated for the boat hull scrubbing apparatus of this invention to be floated over the spanning members without interference therewith. As shown in FIG. 1, frame 3 is a free-floating frame and need not have any permanent foundation or mooring. By utilizing a free-floating frame, the frame rises and falls with the level of the water in the lake or other body of water or with the tide and thus brushes 7*a*, 7*b* are always disposed at the desired level for scrubbing engagement with a hull to be cleaned.

Support frames 9*a*, 9*b* are essentially identical and therefore only support frame 9*a* will be discussed in detail. The support frame includes an open, generally rectangular frame having an inner end member 21, an outer end member 23, and side members 25. As best shown in FIGS, 3, the inner end member 21 of support frame 9*a* has two pairs of clevis members 27 extending endwise therefrom and the inner end member of support frame 9*b* has a pair of lugs 29 extending endwise therefrom, each of which is adapted to be received between a respective pair of clevis members 27. The clevis and the lug members have holes therethrough for reception of pins 11 thereby to pivotally secure or to hinge the inner ends of the support frames together for pivotal movement about a substantially horizontal pivot axis extending generally perpendicular to the longitudinal axis of brushes 7*a*, 7*b* (i.e., parallel to the direction of movement of the boat shown by the arrows in FIG. 1 as the boat is floated between the frame portions).

Each of the bottom brushes 7*a*, 7*b* has a longitudinal center shaft 33 extending lengthwise of its respective support frame and journaled in bearings 35 carried by the inner frame member 21. The outer frame member 23 has a bracket 37 rigidly secured thereto mounting a hydraulic motor 39. This motor is coupled to shaft 33 so that upon operation of the motor, the brush is rotated about its longitudinal axis (i.e., about the axis of shaft 33). The bottom brushes have elongate, relatively stiff bristles B (see FIG. 2) extending radially from shaft 33. These bristles are of such length that they will bend to conform to the shape of the hull.

Figures 4, 5:
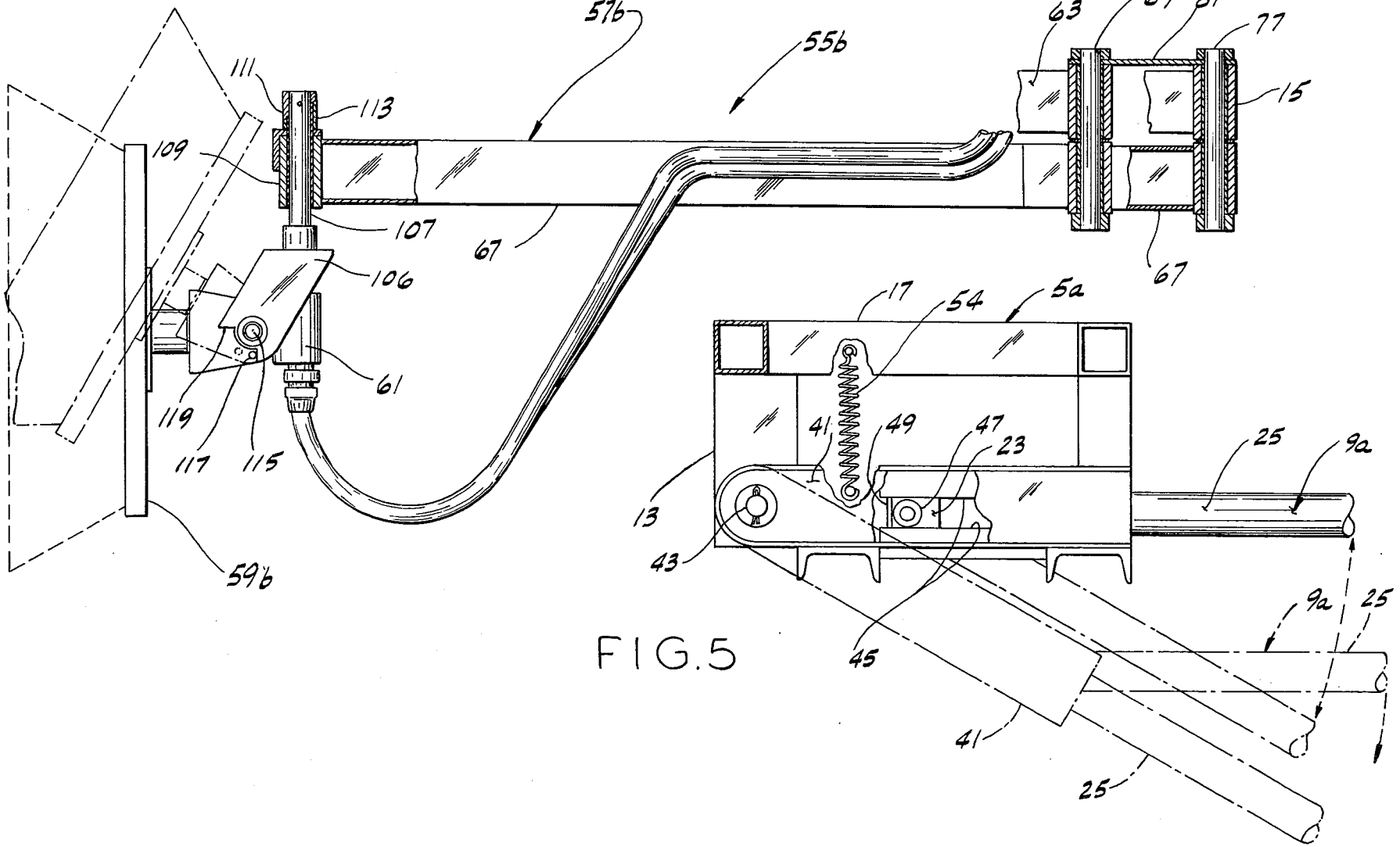
FIG. 4 is an enlarged side elevational view of one of the aforesaid side brushes with parts broken away to show the attachment of the side brush to its mounting arm.
FIG. 5 is an enlarged vertical cross section taken on line 5—5 of FIG. 3 illustrating the mounting of one of the bottom brushes to its respective frame portion so as to permit both vertical and angular movement of the brush relative to its respective frame portion.
Figures 7, 8:
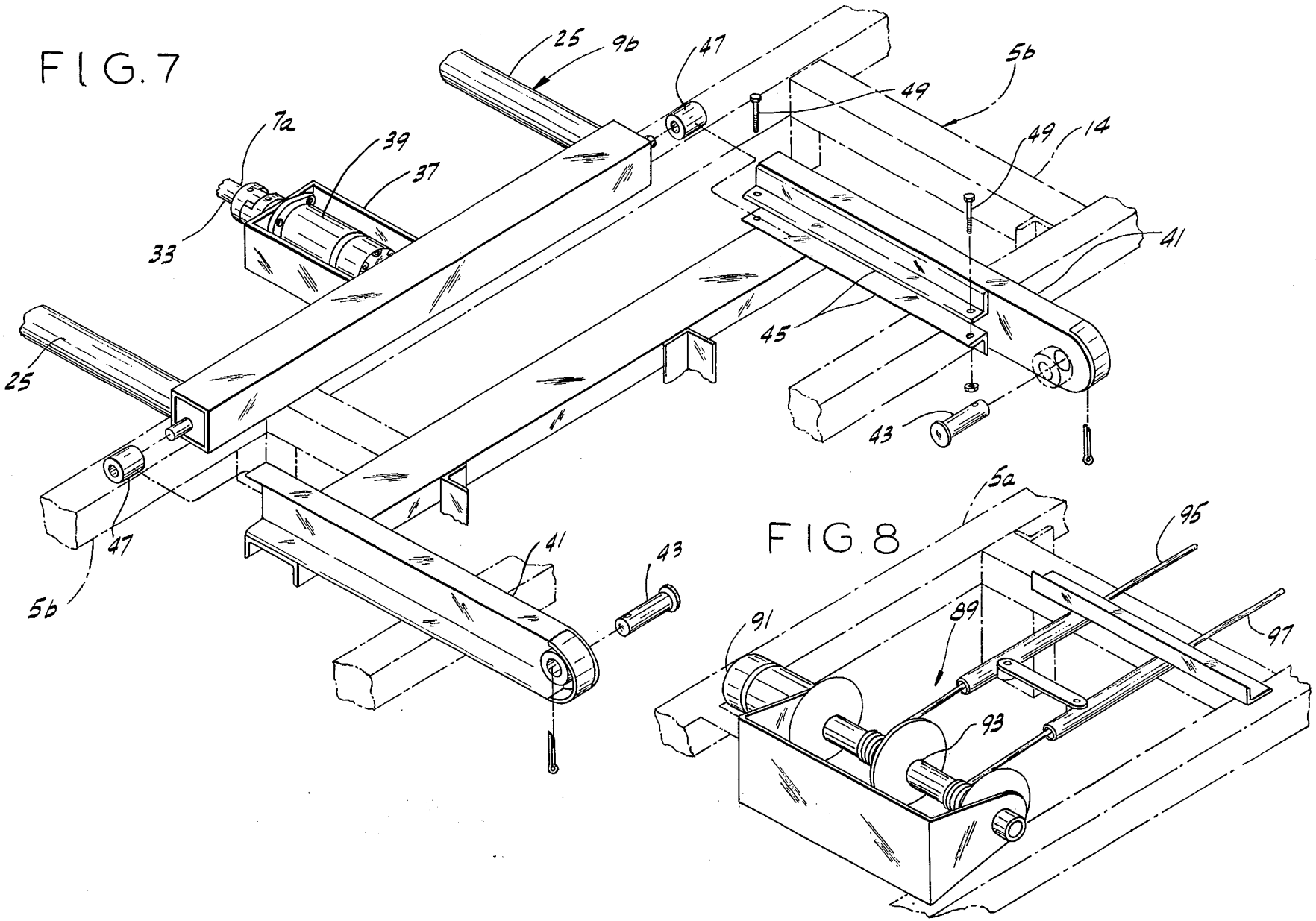
FIG. 7 is an exploded perspective view of the means for mounting one of the bottom brushes to its respective frame portion.
FIG. 8 is a perspective view of a winch carried by one of the frame portions for winding up two flexible lines simultaneously so as to propel a boat to be cleaned between the spaced frame portions and into scrubbing engagement with the side brushes and the bottom brushes.

As best shown in FIGS. 5 and 7, the outer ends of support frames 9*a*, 9*b* are secured to their respective frame portions 5*a*, 5*b* for both vertical and angular movement of the support frames and brushes 7*a*, 7*b* carried thereby relative to the frame portions so as to conform to the shape and depth of the hull being cleaned and thereby to permit the boat scrubbing apparatus of this invention to accommodate hulls having flat bottom, V-shaped or other hull configurations. Each of the frame portions has a pair of spaced arms 41 pivotally secured thereto for swinging in a generally vertical plane about a pair of pins 43, the axes of which constitute a horizontal swinging axis. Arms 41 are shown to extend inwardly toward the opposite side frame and guide tracks 45 are provided on the inner faces of arms 41. Rollers 47 are provided on the outer ends of the support frames and these rollers are adapted to be received in guide tracks and to be movable lengthwise along the guide tracks toward and away from pins 43. Stop bolts 49 at the ends of the tracks hold the rollers captive within the guide tracks. As is shown in FIG. 5, arms 41 are swingable downwardly on pins 43 relative to side frames 5*a*, 5*b*. Support frames 9*a*, 9*b* are movable lengthwise along guide tracks 45 relative to their respective arms 41 and are rotatable about another horizontal axis (i.e., the axis of rollers 47) generally parallel to the swing axis of arms 41 (i.e., the axis of pins 43) whereby the support frames 9*a*, 9*b* and brushes 7*a*, 7*b* carried thereby may move both angularly and vertically relative to one another (see FIG. 5) so as to conform to the shape and depth of the boat hull being cleaned.

Support frames 9*a*, 9*b* and their respective brushes 7*a*, 7*b* are infinitely angularly and infinitely vertically movable to any position between a raised, generally horizontal position (shown in solid lines in FIG. 5) in which arms 41 and the support frames are generally horizontal, and a lowered angled position (shown in phantom in FIG. 5) in which the arms and the support frames are angled downwardly to accommodate boat hulls of various depths and hull shapes (e.g., flat bottom, V-shaped and rounded hull boats). Support frames 9a, 9b each have flotation members 51 secured thereto for biasing the support frames and the bottom brushes 7a, 7b upwardly to a generally horizontal position in the water with the brushes disposed for scrubbing engagement with the hull of the boat to be cleaned. Flotation blocks 51 are positioned below the upper portion of the bottom brushes on both sides of shaft 33 and thus the upper portions of the bottom brushes are free to scrubbingly engage the boat hull. Wheels 53 are mounted on the inner ends of each of the support frames 9a, 9b for engagement with the boat hull as the boat is floated forward between side frames 5a, 5b. These wheels constitute hull following means. A tension spring 54 (see FIG. 5) is interposed between arms 41 and frame 3 thereby to bias the arms upwardly to a generally horizontal position (i.e, to its above-mentioned first position). It will therefore be understood that with the inner ends of support frames 9a, 9b pivotally secured together, with the outer ends of the support frames mounted on frame 3 by means of arms 41 and rollers 47 with flotation blocks 51 biasing the support frames upwardly, and with springs 54 biasing arms 41 upwardly toward a generally horizontal position, that a boat hull engaging wheels 53 will automatically force the support frames to pivot downwardly on pins 11 with consequent downward movement of brushes 7a, 7b thereby to cause the bottom brushes to scrubbingly engage the hull. Flotation blocks 51 and wheels 53 maintain the bottom brushes in proper scrubbing engagement with the hull as it moves over the brushes and the brushes automatically conform to the hull shape and depth.

It will be appreciated that as the support frames 9a, 9b pivot on pins 11 and as the ends of brushes 7a, 7b move downwardy, rollers 47 on the inner ends of the support frames move on guide tracks 45 away from pins 43 thereby to permit the inner ends of the bottom brushes to move downwardly. As generally indicated at W in FIGS. 1 and 2, a hand winch and cable arrangement is provided at an operator's station having a cable C attached to support frames 9a, 9b at their inner ends for enabling the brushes to be selectively drawn down below their normal horizontal raised position to an initial V-shaped or angled position so as to better engage the hull of the boat being cleaned as the boat initially engages the brushes.

As generally indicated at 55a, 55b a pair of side brush assemblies is provided for scrubbing both sides of a boat hull above and below the water line of the boat. Each of these side brush assemblies includes an articulated arm 57a, 57b, and a side brush 59a, 59b. Each of the articulated arms is movable from a retracted position (not shown) in which the arm and its respective side brush are adjacent a respective side frame 5a or 5b to permit a boat to be floated therebetween and an extended scrubbing position (shown in FIGS. 1–3) in which the side brushes are in position for scrubbing engagement with the sides of the boat hull as the latter is floated between the side frames. Each of the side brushes 59a, 59b is rotatably driven on a horizontal axis at relatively low speed by a high torque hydraulic motor 61.

As is best shown in FIG. 2, the articulated arms 57a, 57b are essentially identical and thus only arm 57a will be discussed in detail. More particularly, arm 57a comprises an outer arm 63 pinned, as indicated at 65, to its respective side frame 5a for swinging in a generally horizontal plane toward and away from the side frame, and an inner arm 67 pinned, as indicated at 69, to the outer end of arm 63. A two link actuating arm assembly 71 is pinned between pin 65 on the side frame and the inner end of arm 67, this two link arm comprising a first link 73 journaled on pin 65 and an outer link 75 pinned to the inner end of arm 67, as indicated at 77, with the inner and outer links being pinned together as indicated at 79. A connecting link 81 extends between the outer ends of arm 63 and link 75 on pins 69 and 77. A hydraulic cylinder unit 83 has its cylinder body 85 pinned to link 75 and the free end of its piston rod 87 pinned to arm 63, these cylinder units constituting power operated means for moving arm assemblies 55a, 55b between their retracted and extended positions. Outer arm 63 and links 73, 75 and 81 constitute an unequal parallelogram linkage arrangement and with cylinder unit 83 retracted, the arm assembly is folded into its retracted position and with the cylinder extended, the arm assembly is in its extended position. It will be understood that the above-described parallelogram linkage arrangement multiplies the movement of the hydraulic cylinder unit 83 thereby to effect amplified movement of the side brushes toward and away from the hull to be cleaned.

As generally indicated at 89 in FIG. 8, a power operated winch is provided on side frames 5a for conveying a boat to be cleaned between frame portions 5a, 5b and over brushes 7a, 7b. This winch comprises a hydraulic motor 91 and a divided spool 93 for winding first and second tension lines 95 and 97, the winch being operable to simultaneously wind and unwind both of the lines. As shown in FIG. 1, line 95 extends forward along frame 5a from the winch and is trained around a set of pulleys 99 to extend back along frame portion 5a for attachment via a hook 100 to a boat to be pulled forward by the winch between the frame portions. Line 97 is trained around pulleys 101 to extend down from frame portion 5a, along the spanning member 19 transversely of the frame portions to the other frame portions 5b and back along the other frame portion for attachment to the boat. As shown in FIG. 1, lines 95 and 97 each have a hook 100 on their free end. These hooks are shown to be hooked to frame 3 in a stowed position. In use, hooks 100 are removed from the frame and lines 95, 97 via the hooks are attached to the stern of a boat to be cleaned with the boat being initially positioned at the entrance end of frame 3 and with the bow of the boat adjacent brushes 7a, 7b. Operation of winch 89 simultaneously winds up both lines 95 and 97 and pulls the boat between the frame portions and side brushes 55a, 55b and over bottom brushes 7a, 7b. It will be noted that by utilizing the above-described conveying means in which lines 95, 97 are attached to the stern of a boat to be cleaned and extend along the sides of the boat, frame 3 need not be any longer than the maximum boat length which can be accommodated by the apparatus and may even be somewhat shorter than the maximum boat length. It will be further noted that with both ends of frame 3 open, after a boat has been cleaned, it may be moved forward out of apparatus 1 of this invention rather than having to back it out over brushes 7a, 7b. Of course, it will be understood that a conventional winch or other means may be used in place of the winch arrangement 89 described above to convey the boat through the apparatus of this invention.

Figure 6:
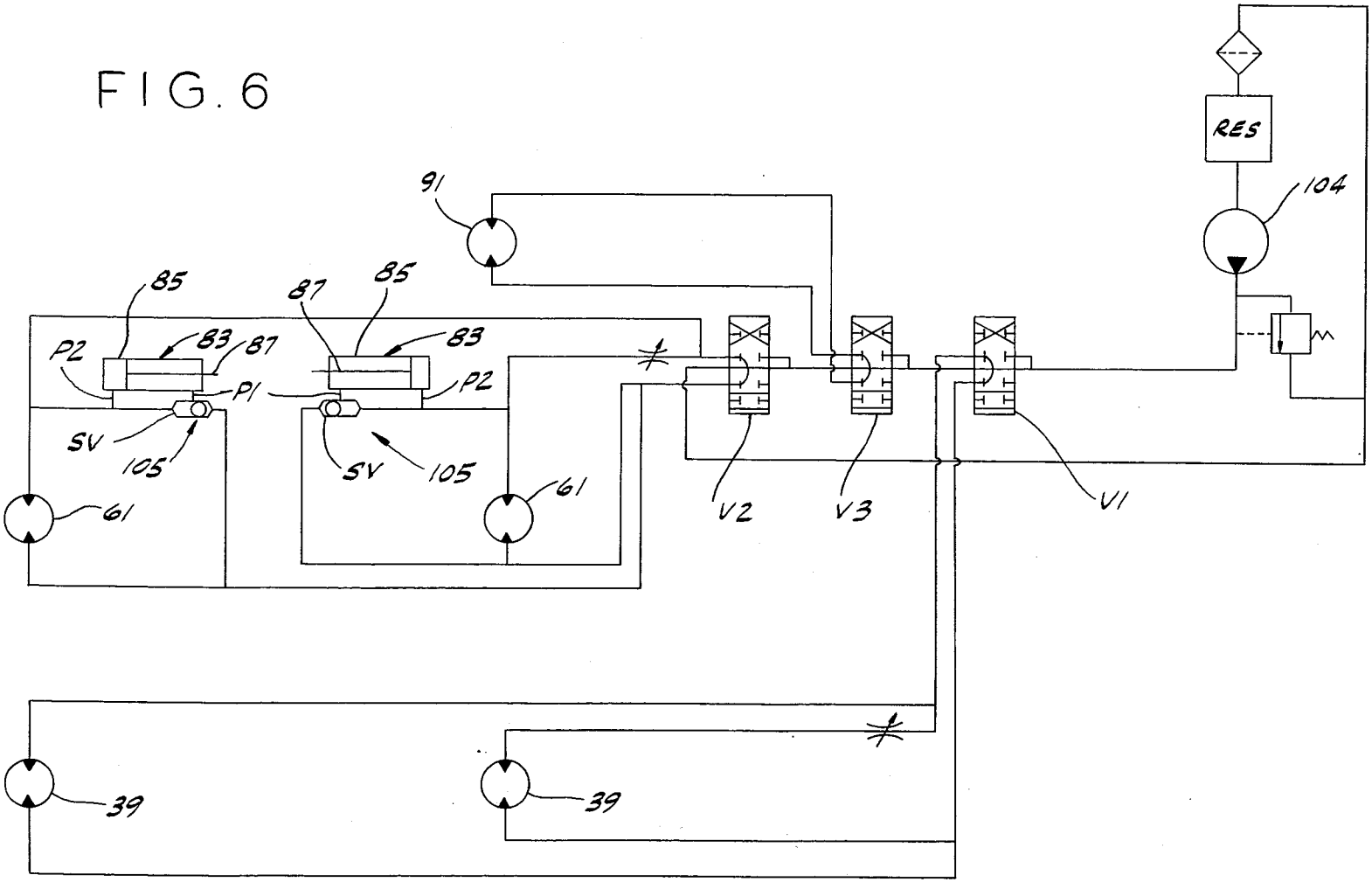
FIG. 6 is a schematic of a hydraulic system for the apparatus of this invention.

The various hydraulic components (e.g., motors 39, 61 and 69, and hydraulic cylinders 83) of the apparatus of this invention are controlled by an operator at a control panel 103. The hydraulic system of the present application is best shown in FIG. 6 to include an electric motor and a hydraulic pump 104 for supplying hydraulic pressure via a hand-actuated, multi-position valve V1, V2 or V3 on panel 103. These valves V1, V2, V3, respectively, control operation of motors 39, motors 61, and hydraulic cylinders 83, and winch motor 91 in a manner well-known to those skilled in the art.

In accordance with this invention, means, as is indicated generally at 105, is provided for maintaining a minimum scrubbing force between the side brushes 59*a*, 59*b* and the sides of the boat hull and for limiting the force applied by the hydraulic cylinders 83 via the side brushes to the hull whereby if this force level exceeds a predetermined value, hydraulic cylinder units 83 are pressurized to effect partial retraction of the side arm assemblies 55*a*, 55*b* away from the boat hull so as to lower the scrubbing force applied by the side brushes to the boat hull and to prevent damage thereto. More particularly, means 105 is shown to comprise a shuttle valve SV interconnected in the hydraulic lines between the ports P1 and P2, respectively, at the rod and cap ends of each cylinder 85 of hydraulic cylinder units 83. This shuttle valve is actuable in response to hydraulic pressure at both ports of the cylinder for maintaining the pressure differential between the ports within a predetermined range, this pressure differential being such that hydraulic cylinders 83 will exert a predetermined force on side arms 57, 57*b* and move the side brushes 59*a*, 59*b* outwardly from their retracted positions to their extended positions for scrubbing engagement with the hull and thus will exert a predetermined force on the side brushes. As winch 89 pulls the boat forward past the side brushes and as the side brushes move aft along the sides of the boat, the side brushes will be forced outwardly toward their retracted positions thus forcing piston rods 87 into their cylinders 85, and causing the pressure to increase at the cap end of the cylinder. Shuttle valves SV will automatically maintain the desired hydraulic pressure difference on the cap and rod end ports and will thus maintain the desired force on the side brushes while permitting the side arms to be folded toward their retracted positions. In this manner, the side brushes are maintained in scrubbing engagement with the sides of the hull and are moved to conform to the shape of the hull as the boat is moved through apparatus 1 of the present invention.

As shown in FIGS. 2 and 4, brushes 59*a*, 59*b* are each pivotally secured to their arm by a yoke 106 having a vertical mounting shaft 107 extending therefrom into a bushing 109 carried by arm 67. Shaft 107 has a brush locating cam 111 fixedly secured thereto and being engageable with an inclined upwardly facing collar 113. Shaft 107 is free to rotate and to move axially within bushing 109 whereby the full weight of motor 61 and the side brush carried thereby is supported by locating cam 111 bearing on the upwardly facing surface of collar 113 so that the weight biases the side brushes to a home position (shown in solid lines in FIG. 3) in which the side brush faces generally inwardly toward a boat hull to be cleaned when side brush assemblies 55*a*, 55*b* are in their extended positions. Motor 61 is pivotally movable about a generally horizontal axis, as indicated at 115, relative to yoke 106 from a generally vertical position to an upwardly inclined position as shown in FIG. 4 for scrubbing upright and inclined hull sidewalls. Pins 117 engage surfaces 119 of yoke 106 to limit movement of motor 61 and side brushes 59*a*, 59*b* on pin 115.

It will be understood that in place of locating cam 111 and collar 113, means may be provided, such as a hydraulic actuator, on the free end of arm 67 for selectively rotating side brushes 59*a*, 59*b* thereby to properly position the side brushes relative to the bow, side and stern walls of a boat being cleaned.

Thus, as side brush assemblies 55*a*, 55*b* are moved toward their extended positions, side brushes 59*a*, 59*b* will automatically be positioned in their home positions (as shown in FIG. 3) relative to arms 67 and in their vertical position (as shown in solid lines in FIG. 4) awaiting engagement by the hull of a boat to be cleaned. Upon scrubbingly engaging the bow of the hull, each side brush will automatically rotate about pin 107 from its home position so as to be generally parallel to the front side wall of the boat, even if the front of the boat is "square". As the boat moves between the side brushes, it will force the side brushes outwardly and, as heretofore explained, means 105 (e.g., shuttle valves SV) will maintain a desired force between the side brushes and the hull with side arm assemblies retracting as required. Upon the side brushes reaching the stern of the boat hull, the pressure exerted on the side brushes by hydraulic cylinders 83 will cause the side brushes to rotate on pins 107 to face toward the stern. As the side brushes move from the sides to the back of the boat, the shuttle valves SV will effect the side arm assemblies toward their inner extended positions.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. Apparatus for scrubbing the hull of a boat comprising a frame having two portions spaced a distance sufficient for a boat to be floated therebetween, a pair of power driven brushes extending generally transversely between said frame portions, means supporting each of said brushes for rotation about its longitudinal axis, means pivotally securing said supporting means together adjacent their inner ends for pivoting relative to one another about a substantially horizontal pivot axis extending generally perpendicular to the longitudinal axis of said brushes, means for mounting the outer end of each of said supporting means to its respective frame portion for vertical movement, for horizontal movement toward and away from its opposite frame portion, and for angular movement of each of said supporting means and its respective brush relative to its respective frame portion from a first position in which the brushes and the supporting means are generally horizontal for engagement of the brushes by the hull of a boat to be cleaned to a second position in which the brushes are angled downwardly from their said first positions and are disposed below the hull of the boat for scrubbingly engaging the latter with the pivotally connected inner ends of said supporting means being movable vertically downwardly and pivoting relative to one another and with the outer ends of the supporting means being movable vertically and angularly downwardly and horizontally inwardly relative to their respective frame portions as said brushes move from their said first positions to their said second positions to conform to the shape of the boat hull being cleaned, the position of the brushes being changeable to conform to the shape and depth of the boat hull and means for biasing the brushes upwardly toward their said first positions whereby the brushes are maintained in scrubbing engagement with the boat as the latter is floated over the brushes.

2. Apparatus as set forth in claim 1 wherein said supporting means for each of said brushes comprises a support frame journaling its respective brush for rotation about the longitudinal axis of the brush, the inner ends of the support frames of each of said brushes being pivotally secured together for permitting pivotal movement of the support frames relative to one another about said pivot axis.

3. Apparatus for scrubbing the hull of a boat comprising a frame having two portions spaced a distance sufficient for a boat to be floated therebetween, a pair of power driven brushes extending generally transversely between said frame portions, a support frame mounting each of said brushes for rotation about its longitudinal axis, said support frames being pivotally secured together adjacent their inner ends for permitting pivotal movement of the support frames relative to one another about a substantially horizontal pivot axis extending generally perpendicular to said longitudinal axis of said brushes and means for securing the outer end of each said support frame to its respective frame portion for vertical and angular movement of the support frame and the brush carried thereby relative to its respective frame portion thereby to permit pivotal movement of the brushes relative to one another from a first position in which the brushes are generally horizontal for engagement by the hull of a boat to be cleaned to a second position in which the brushes are disposed below the hull of the boat, the position of the brushes being changeble to conform to the shape and depth of the boat hull whereby the brushes are maintained in scrubbing engagement with the boat as the latter is floated over the brushes, said securing means for each of said support frames comprising a pair of spaced arms pivotally secured to a respective frame portion for swinging in a generally vertical plane about a substantially horizontal swing axis extending generally parallel to said pivot axis, said arms extending generally inwardly toward the opposite frame portion, guide tracks on said arms, and roller means on the outer end of each of said support frames for reception in said guide tracks, said arms being swingable downwardly relative to its respective frame portion about said swing axis, and said support frame being movable along said guide tracks and being rotatble relative to said arms about another horizontal axis generally parallel to said swing axis whereby said support frames and said brushes carried thereby may move both angularly and vertically relative to the frame so as to conform to the shape and depth of the boat hull being cleaned.

4. Apparatus as set forth in claim 1 wherein said support frames each carry means constituting hull follower means adapted to engage the hull of a boat as the latter is moved between the frame portions for effecting movement of the support frames relative to said frame portions whereby said biasing means and said hull follower means maintain the brushes in scrubbing engagement with the hull.

5. Apparatus as set forth in claim 1 further comprising a pair of side brushes and a pair of articulated arms, one for each side of a boat to be cleaned, each of said arms being secured to a respective said frame portion and carrying a respective side brush, each of said arms being movable from a retracted position in which said arm is adjacent its respective frame portion and an extended scrubbing position in which its side brush is in position for scrubbing engagement with the side of the boat as the latter is floated between said frame portions.

6. Apparatus as set forth in claim 5 further having power operated means carried by each of said arms for rotatably driving said side brushes.

7. Apparatus as set forth in claim 5 further comprising power operated means for moving said arm between its retracted and extended positions.

8. Apparatus as set forth in claim 7 wherein said power operated means includes means for maintaining a minimum scrubbing force between the side brush and the boat hull and for limiting the force applied by the power operated means via the side brush to the boat hull whereby upon this last-mentioned force exceeding a predetermined value, said power operated means effects partial retraction of said side brush away from the boat thereby to lower the scrubbing force applied by the side brush to the hull of the boat.

9. Apparatus as set forth in claim 5 wherein each of said side brushes is rotatably driven about a generally horizontal axis and is mounted for pivotal movement about a vertical axis relative to its respective said arm so as to permit said side brush to scrub the bow, side and stern walls of said boat hull.

10. Apparatus as set forth in claim 9 wherein each of said side brushes includes means for pivoting said side brush relative to its respective arm about said vertical axis so that the scrubbing face of the brush is disposed for scrubbing engagement with the bow, side and stern walls of the boat hull.

11. Apparatus as set forth in claim 1 further comprising means for conveying a boat to be cleaned between said frame portions and over said brushes.

12. Apparatus as set forth in claim 11 wherein said conveying means comprises a power operated winch carried by one of said frame portions, first and second tension lines, said winch being operable to simultaneously wind and unwind both of said lines, said first line extending along said one frame portion and said second line extending from said winch below the bottom of the boat hull to be cleaned and then along the other of said frame portions, said lines being securable to the boat to be cleaned whereby upon said winch winding up said lines said boat is pulled between said frame portions and over said brushes.

13. Apparatus as set forth in claim 8 wherein said power operated means comprises a hydraulic cylinder unit, and wherein said scrubbing force maintaining and limiting means comprises valve means responsive to changes in the hydraulic pressure differential on said cylinder unit so as to maintain said pressure differential within a specified range thereby to maintain a minimum scrubbing force between the side brushes and the hull and to limit said scrubbing force below said predetermined valve.

* * * * *